US006422776B1

(12) United States Patent
Nakatani

(10) Patent No.: US 6,422,776 B1
(45) Date of Patent: Jul. 23, 2002

(54) BALL-POINT PEN AND A PENPOINT TIP THEREIN

(75) Inventor: Yasunori Nakatani, Amagasaki (JP)

(73) Assignee: Sakura Color Products Corporation, Osaka (JP)

( * ) Notice: Subject to any disclaimer, the term of this patent is extended or adjusted under 35 U.S.C. 154(b) by 0 days.

(21) Appl. No.: 09/665,457

(22) Filed: Sep. 19, 2000

(30) Foreign Application Priority Data

Sep. 20, 1999 (JP) ..... 11-265232
Sep. 20, 1999 (JP) ..... 11-265233
May 30, 2000 (JP) ..... 2000-160785

(51) Int. Cl.[7] ..... B43K 7/10
(52) U.S. Cl. ..... 401/216; 401/209
(58) Field of Search ..... 401/216, 215, 401/209, 208

(56) References Cited

U.S. PATENT DOCUMENTS 5,520,473 A * 5/1996 Durham ..... 401/216
5,876,142 A * 3/1999 Furukawa ..... 401/216
5,904,432 A * 5/1999 Ando et al. ..... 401/216
6,082,920 A * 7/2000 Furukawa ..... 401/216

* cited by examiner

*Primary Examiner*—David J. Walczak
(74) *Attorney, Agent, or Firm*—Howard C. Miskin; Gloria Tsui-Yip; David M. McConoughey

(57) ABSTRACT

A ball-point pen comprising:

a. an ink reservoir, b. a penpoint tip, c. a writing ball rotationally disposed in and partially exposed from the penpoint tip, d. an ink feed bore in fluid communication with the ink reservoir, e. a ball chamber holding the writing ball and formed in fluid communication with the ink feed bore, f. an annular seat formed in the chamber so as to support the writing ball, and g. radial grooves formed in the annular seat, characterized in that each of the radial grooves is of a width of more than 0.2 mm.

15 Claims, 7 Drawing Sheets

BALL-POINT PEN AND A PENPOINT TIP THEREIN

FIELD OF THE INVENTION

The present invention relates to a ball-point pen.

BACKGROUND OF THE INVENTION

Ball-point pens are well known and widely used as writing tools, and each comprise a writing ball rotationally held in a penpoint tip. An ink filled in an ink reservoir fixed in the ball-point pen will be guided in use to the writing ball so as to be transferred to a paper, sheet or the like, as the ball rotates.

The prior art penpoint tips have been constructed such as shown in FIGS. 6(*a*) and 6(*b*). Each tip consists of a tip body 100 and a writing ball 102, and this body 100 has a distal end 101 of a conical shape. The writing ball 102 held in a ball chamber 103 is gripped with the annular distal end 101.

In detail, the interior of the penpoint tip is as follows. The ball chamber 103 formed as a cavity is disposed in a distal region, and an ink inlet opens at a proximal end of the penpoint tip. A thin axial bore 110 is in fluid communication with both the ball chamber 103 and the proximal ink inlet. Several radial grooves 107, usually called 'spoke-like' grooves, are formed in a seat 105 for supporting the ball fitted in this chamber 103.

Those radial grooves 107 in the prior art ball-point pens have each been of a width of 0.14 mm or less. A clearance between the outer spherical surface of the ball 102 and the inner peripheral wall of the chamber 103 has been 15 $\mu$m or less.

Oily inks have been employed particularly for use with such ball-point pens. Recently, some types of novel ball-point pens are also known which are filled each with an aqueous thixotropic ink. These thixotropic inks have such a characteristic feature as varying in viscosity as they flow.

Each of these thixotropic inks is of a high viscosity typically ranging from 100 to 2000 mPa·s while standing still, for example, within an ink reservoir. It will however show an extremely low viscosity for instance of 10 mPa·s or less when flowing through the penpoint tip. Those inks whose aqueous matrices are blended each with a thixotropic gelling agent or thickener are usually called water-soluble gel inks.

An aqueous ink composition containing a brilliant pigment, such as a glass flake pigment or a metal-coated inorganic pigment, is disclosed in the Japanese Patent Application No. 11-76868. An average particle diameter is preferably 20–50 $\mu$m for the pigment in this type of aqueous ink composition. Such an ink having the newly employed brilliant pigment of the average diameter of 20–50 $\mu$m dispersed in said composition has afforded much more brilliant and stereoscopic writings or membranes on an ink-applied surface, as compared with the prior art inks containing ordinary brilliant pigments.

The present applicant has repeated continuous-writing tests with use of a thixotropic one containing glass flake pigments or the like selected from the aqueous inks disclosed in the preceding Application No. 11-76868. The ordinary ball-point pens filled with this ink have, however, proved unsatisfactory due to blurs or unsmoothness appearing in the written letters or the like. Further, the penpoint became clogged in the course of writing. These inconveniences have also been found in the case of using water-soluble gel inks each containing a metallic-luster pigment such as aluminum powder, or a titanium oxide pigment.

SUMMARY OF THE INVENTION

In view of such a drawback, it is therefore desirable to provide a ball-point pen that ensures a smooth writing free from any blur, incontinuity or clogging even if filled with a thixotropic aqueous ink containing a brilliant pigment or a glass flake pigment that comprises relatively coarse particles.

Desirably, a ball-point pen comprising: a. an ink reservoir, b. a penpoint tip, c. a writing ball rotationally disposed in and partially exposed from the penpoint tip, d. an ink feed bore in fluid communication with the ink reservoir, e. a ball chamber holding the writing ball and formed in fluid communication with the ink feed bore, f. an annular seat formed in the chamber so as to support the writing ball, and g. radial grooves formed in the annular seat, characterized in that each of the radial grooves is of a width of about 0.15 mm or more, overcomes these drawbacks.

BRIEF DESCRIPTION OF THE DRAWINGS

FIG. 3(*b*) is a transverse section taken along the line A—A in FIG. 3(*a*);

FIG. 4(*b*) is a transverse section taken along the line A—A in FIG. 4(*a*);

FIG. 5(*b*) is a transverse section taken along the line A—A in FIG. 5(*a*);

FIG. 6(*b*) is a transverse section taken along the line B—B in FIG. 6(*a*)

DESCRIPTION OF THE PREFERRED EMBODIMENTS

Figure 1:
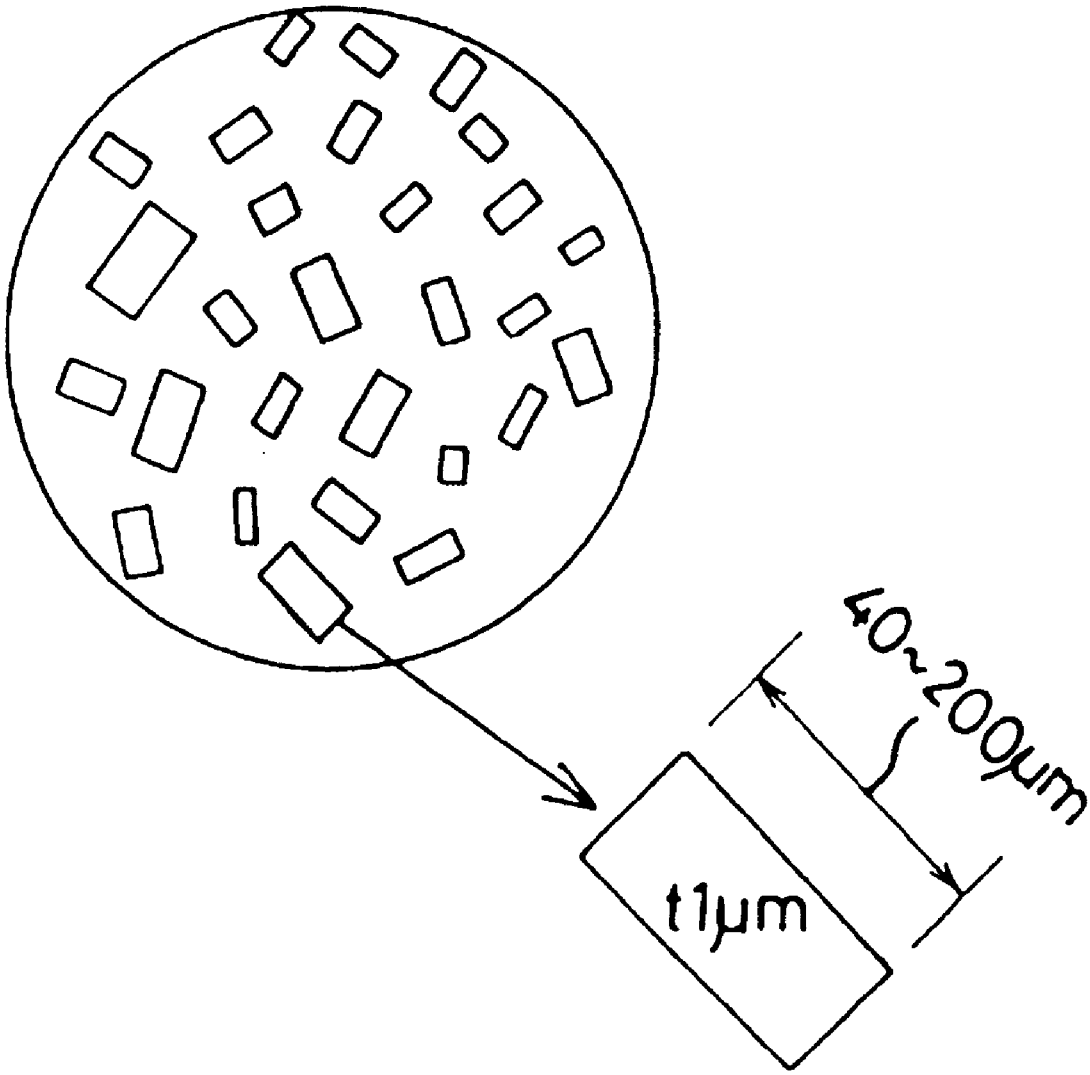
FIG. 1 is a schematic view of constituent particles in a glass flake pigment.

The present invention provides an improved ball-point pen that comprises an ink reservoir, a penpoint tip, a writing ball rotationally disposed in and partially exposed from the penpoint tip, and an ink feed bore in fluid communication with the ink reservoir, a ball chamber holding the writing ball and formed to be in fluid communication with the ink feed bore, an annular seat formed in the chamber so as to support the writing ball, and radial grooves formed in the annular seat, characterized in that each of the radial grooves is of a width of about 0.15 mm or more.

Such broadened radial grooves formed in the seat present in the ball chamber and each being about 0.15 mm wide, or more preferably 0.15 mm wide or more, desirably protects the penpoint tip from being jammed by an aqueous ink, notwithstanding the glass flake pigment dispersed therein. The present invention now allows these inks to flow smoothly.

From an aspect of the present invention, the aqueous ink filled in the reservoir contains a pigment or pigments whose particles have various diameters and an average diameter falling within a range from about 20 to about 50 μm.

As to the pigment or pigments, the maximum diameter of the particles is from about 40 μm to 200 μm.

From another aspect, at least one pigment selected from the group consisting of glass flake pigments, titanium oxide pigments, metal-oxide coated inorganic pigments, metal powder pigments, and pearl-glossy pigments are preferably contained in the aqueous ink.

In these aspects, all the inks are suited to the structural feature of the ball-point pen.

Preferably, the writing ball has a diameter from about 0.8 mm or more, preferably from 0.8 mm or more, and each radial groove has a width of about 0.20 mm or more, preferably 0.20 mm or more.

More preferably, the writing ball has a diameter of 0.9 mm or more.

From a yet still further aspect, an annular ink passage having a depth from about 20 to about 40 μm (preferably from 20 to 40 μm) in radial direction takes place when the writing ball rests on the seat in such a state that the center of the ball is aligned with the longitudinal central axis of the ball chamber, wherein the depth is defined between an inner periphery of the chamber and a peripheral zone of the ball, with this zone being located downstream of an 'equator' of the ball and adjacent to an end distal opening of the chamber. (The term 'equator' denotes herein a circumferential zone that is included in a hypothetical plane lying perpendicular to the longitudinal axis of the pen). In this ball-point pen of the present invention, a clearance between the writing ball and the ball chamber is enough for the ink to flow smoothly without fear of producing any unintentional broken lines in writings, even if the ink contains therein any brilliant pigment or the like.

From another aspect, a ball-point pen, in accordance with the present invention comprises an ink reservoir, a penpoint tip, a writing ball rotationally disposed in and partially exposed from the penpoint tip, and an ink feed bore in fluid communication with the ink reservoir, a ball chamber holding the writing ball and formed to be in fluid communication with the ink feed bore, an annular seat formed in the chamber so as to support the writing ball, and radial grooves formed in the annular seat, characterized in that the writing ball has a diameter of about 1.0 mm or more, each of the radial grooves is of a width of about 0.2 mm or more, and the aqueous ink filled in the reservoir contains a glass flake pigment whose particles of varied diameters have a maximum diameter included in a range from about 40 μm to 200 μm.

From still another aspect, a penpoint tip in a ballpoint pen, in accordance with the present invention does comprise a writing ball, a tip body, an ink inlet formed in the tip body so as to receive an ink from an ink reservoir (preferably not included in this tip), and a ball chamber holding therein the ball and formed in fluid communication with the ink inlet, the chamber having a distal end opening, an annular seat for the ball and a plurality of radial grooves formed in the seat, the writing ball being capable of rotating within the chamber and exposed outwards and partially from the distal end opening of the chamber, characterized in that the writing ball has a diameter of about 0.9 mm or more (preferably 0.9 mm or more), each of the radial grooves is of a width of about 0.15 mm or more (preferably 0.15 mm or more), and an annular ink passage having a depth from about 20 to about 40 μm (preferably from 20 to 40 μm) in radial direction takes place when the writing ball resting on the seat has a center aligned with a longitudinal central axis of the ball chamber, wherein the depth is defined between an inner periphery of the chamber and a peripheral zone of the ball, with this zone being located downstream of an equator of the ball and adjacent to the distal end opening of the chamber.

In this penpoint tip of the present invention just described above, those grooves formed in the seat present in the ball chamber are of a sufficient width, and the annular clearance intervening between the ball and the inner periphery of said chamber is also of a sufficient depth in radial direction. Thus, a broad passage is provided for the ink flowing through those grooves and the clearance. In addition, the writing ball has a diameter of 0.9 mm or more that is large enough for the ball to carry and transfer continuous amounts of the aqueous ink, even if it contains a relatively coarse pigment. Therefore, the penpoint tip of the present invention is protected well from being jammed with aqueous inks each containing such a coarse pigment, and consequently is adapted for special use with such aqueous inks.

In accordance with the present invention a writing ball freely displaceable a considerable distance longitudinally of the pen would ensure that the thixotropic ink would flow out smoothly even if the ink had contained therein a relatively coarse glass flake pigment or the like.

One aspect of the present invention will thus provide herein a ball-point pen that comprises a ink reservoir, a penpoint tip in fluid communication therewith, a writing ball rotationally held in and partially exposed from the penpoint tip, and a thixotropic ink filled in the reservoir, wherein the writing ball is movable a distance from about 60 to about 170 μm within the pen-point tip and longitudinally of the pen.

Such a freedom in axial displacement of the writing ball which the pen of the present invention comprises, will afford around it a sufficient interstice for the thixotropic ink containing any brilliant pigment to flow smooth.

From another aspect of the present invention, the aqueous ink filled in the reservoir contains a pigment or pigments whose particles have various diameters and an average diameter falling within a range from about 20 to about 50 μm.

As to the pigment or pigments, the maximum diameter of the particles is from about 40 μm to 200 μm.

From another aspect of the present invention, the ink filled in the reservoir may contain at least one pigment selected from the group consisting of glass flake pigments, titanium oxide pigments, metal-oxide coated inorganic pigments, metal powder pigments, and pearl-glossy pigments.

Preferably, the diameter of the writing ball is 0.8–1.1 mm.

One preferable aspect of the present invention relating to the foregoing is the provision of a ball-point pen, in accordance with the present invention that comprises a ink reservoir, a penpoint tip in fluid communication therewith, a writing ball with diameter of from about 0.8 to about 1.1 mm rotationally held in and partially exposed from the penpoint tip, and a thixotropic ink filled in the reservoir, wherein the writing ball is movable a distance from about 60 to about 170 μm within the penpoint tip and longitudinally of the pen, wherein the ink contains at least one pigment selected from brilliant pigments including glass flake pigments and metal-coated inorganic pigments, metallic-luster pigments including metal powder such as an aluminum powder, white pigments including titanium oxide, and pearl-glossy pigments, wherein the average particle diameter is from about 20 to about 50 μm.

The present ball-point pen in accordance with the present invention, is intended for use with special aqueous inks. For this reason, the properties and composition of these inks will be detailed before the full description of the structural features of the ball-point pen, of the present invention itself.

The inks for use herein are aqueous and thixotropic inks each containing a glass flake pigment or a metal-coated inorganic pigment, and these pigments may possibly include coarse particles whose diameter (viz., overall length) is extremely large.

The ink reservoir is filled with an ink of thixotropic property, as mentioned above. Contained in this type of ink may be thixotropic polysaccharides or derivatives thereof, as gelling agents or thickeners blended with the ink. Particularly preferred for the ink for use in accordance with the present invention, are natural polysaccharides or their derivatives, such as microbial polysaccharides, water-soluble vegetable polysaccharides, water-soluble animal polysaccharides and any derivatives thereof.

The microbial polysaccharides and derivatives referred to here may be: 'pluran', xanthan gum, welan gum, rhamsan gum, succinoglucan, dextran or the like. The vegetable polysaccharides and derivatives may be: tragacanth gum, guar gum, tara gum, locust bean gum, ghatti gum, arabinogalactan gum, Arabic gum, quince seed gum, pectin, starch, psyllium seed gum, carrageenan, alginic acid, agar or the like. The animal polysaccharides and derivatives may be gelatin, casein or the like.

As for the kinds of pigments, brilliant pigments including glass flake pigments and metal-coated inorganic pigments, metallic-luster pigments including a metal powder such as an aluminum powder, pearl-glossy pigments, and white pigments including titanium oxide are suited for use in the present invention. Any one of them may be used alone or, alternatively, any two or more may be used in combination.

Each glass flake pigment consists of a number of glass flakes respectively covered with a metal coat or the like, giving the ink a brilliancy and stereoscopic appearance. For example, glass flakes of the pigment are coated with a metal produced by the non-electrolytic plating method. In another example, metal coats on the flakes may be formed by the sputtering method.

Glass flakes in this type pigment are of a configuration as schematically shown in FIG. 1.

All the particles or flakes in each glass flake pigment are flat pieces having a thickness of about 1 μm. However, they differ from each other as to their diameter (viz., overall length), as seen in FIG. 1.

Therefore, an average diameter or a median diameter will be an appropriate index for indicating coarseness of the glass flakes. In order for an ink to provide brilliancy and stereoscopic impression when using a ball-point pen filled with same, an average diameter of flakes or particles dispersed in he ink may desirably be selected to fall within a range from about 20 μm to about 50 μm. If the average diameter of glass flakes is smaller than 20 μm, then they are too minute to afford the required brilliancy and thus render the pigment not worthy of presence in the ink. If contrarily the average diameter is greater than 50 μm, then they are too much coarse as a whole to successively protect the penpoint tip from being clogged with them.

Due to unavoidable variation in the diameter of glass flakes as the particles constituting a pigment as discussed above, it is a matter of course that larger flakes of diameters greater than the average as well as smaller flakes of diameters less than it will be introduced into the ink. In an exemplary case wherein the average diameter is 20 μm that is the lower limit as set forth above, coarse flakes having diameters up to about 40 μm will usually be present in the ink blended with such a pigment. In another exemplary case wherein the average diameter is 50 μm that is the upper limit as set forth above, coarse flakes having diameters up to about 200 μm will be present in the ink blended with such a pigment.

Glass flake pigments are in general of the nature as just summarized above. Some pigments of this type now available on the market are such that their glass flakes are coated with a metal by the non-electrolytic plating method. Examples coated with silver are: "Metashine REFSX-2015PS," "Metashine -2025PS" and "Metashine -2040PS," all being the trade names of the products made by the Toyo Aluminum Co., Ltd.

In another type glass flake pigments, the glass flakes are coated with a metal by the sputtering method. Examples of the glass flakes coated with silver are: "Crystal Color GF -2125", "Crystal Color GF -2125M", "Crystal Color GF. 2140" and "Crystal Color GF -2140M." Examples of the glass flakes coated a nickel-chromium-molybdenum alloy are: "Crystal Color GF 2525", "Crystal Color GF -2525M", "Crystal Color GF. -2540" and "Crystal Color GF. -2540M." Examples coated with a brass, a silver alloy and titanium are: 'GF250', 'GF1345' and 'GF1445', respectively, all of these trade names being for the products made by the Toyo Aluminum.

About 0.1% to about 20.0% by weight of any of these glass flake pigments may be contained in the ink composition. If the content of the pigment is less than 0.1% by weight in the ink composition, brilliancy and stereoscopic feeling given thereby will not be satisfactory. If the content exceeds 20% by weight, then an excessively high viscosity will impair flowability of the ink. A more desirable content is 1.0–10.0% by weight for the glass flake pigments.

'Metal-coated inorganic pigments' are such as follows. This term is meant herein to include those whose particles are coated with at least one of metals and/or oxides thereof. For example, coating is performed by means of vacuum evaporation.

Inorganic pigments coated with a metal and/or its oxide are usable herein as brilliant pigments. Available on the market are aluminum powders coated with iron (III) oxide, for example "Paliocrom Gold L2000/L2002", "Paliocrom Gold. L2020/L2022", "Paliocrom Goldi. L2025", "Paliocrom Orange L2800", all being trade names for the products made by the BASF GmbH.

Pigments whose core particles of mica are coated iron (III) oxide are also known as 'metal-coated inorganic pigments', and examples thereof being "Paliocrom Red Gold L2500" and 'ibid. "Paliocrom Red L4000". Mica-shaped iron (III) oxide coated with an alloy of aluminum and manganese includes the BASF's 'Paliocrom Copper L3000' and "Palicrom Copper. L3001". Further, mica coated with reduced titanium dioxide or normal titanium oxide are also known as ones of the metal-coated inorganic pigments.

For the same reasons as in the case of glass flake pigments, these metal-coated inorganic pigments have preferably an average particle diameter from about 20 to about 50 μm and are to be contained by the same or similar amount in the ink composition.

Examples of the metallic-luster pigments are an aluminum powder, a brass powder, a copper powder, a gold powder and a silver powder. The aluminum powder pigment may either be of the leafing type or of the non-leafing type.

Examples of the pearl-glossy pigments are: Iriodin-100, "Iriodin-103", "Iriodin 111", "Iriodin -120", "Iriodin -123", "Iriodin -151", -"Iriodin -153", Iriodin-163", "Iriodin-173", "Iriodin-201", "Iriodin-211", "Iriodin -221", "Iriodin -223", "Iriodin -231", "Iriodin 205", "Iriodin -215", "Iriodin -217", "Iriodin -219", "Iriodin -225", "Iriodin -235", "Iriodin 249", "Iriodin -259", "Iriodin -289", "Iriodin -299", Timiron MP-115", "Timiron-1001", "Timiron -47", "Timiron -1005", "Timiron -10", "Timiron -45SP", and Extender W (all being the trade names of products made by the Merck Japan Ltd.).

An alternative type of the inks selectively filled in the ink reservoir is the thixotropic and double-color developing inks.

Each of this type of ink comprises a first colorant readily diffusing in a surface to which the ink is being applied, and a second colorant hardly diffusing in said surface. An example of this ink is composed of a metal powder pigment, a water-soluble dye, water and a permeable organic solvent. If this ink is applied to a solvent-absorbing paper sheet or fabric to write thereon any characters, symbols and/or figures, then the metal powder pigment will remain within contour of each character or the like, with the water-soluble dye, carried by the solvent however, migrating out of said contour. The written characters or the like will thus look as if they were rimmed with a different color giving them a certain sophisticated appearance.

Embodiment No. 1

Now structural features of ball-point pens, in accordance with the present invention in several specific embodiments will be described with reference to the drawings.

Figure 2:
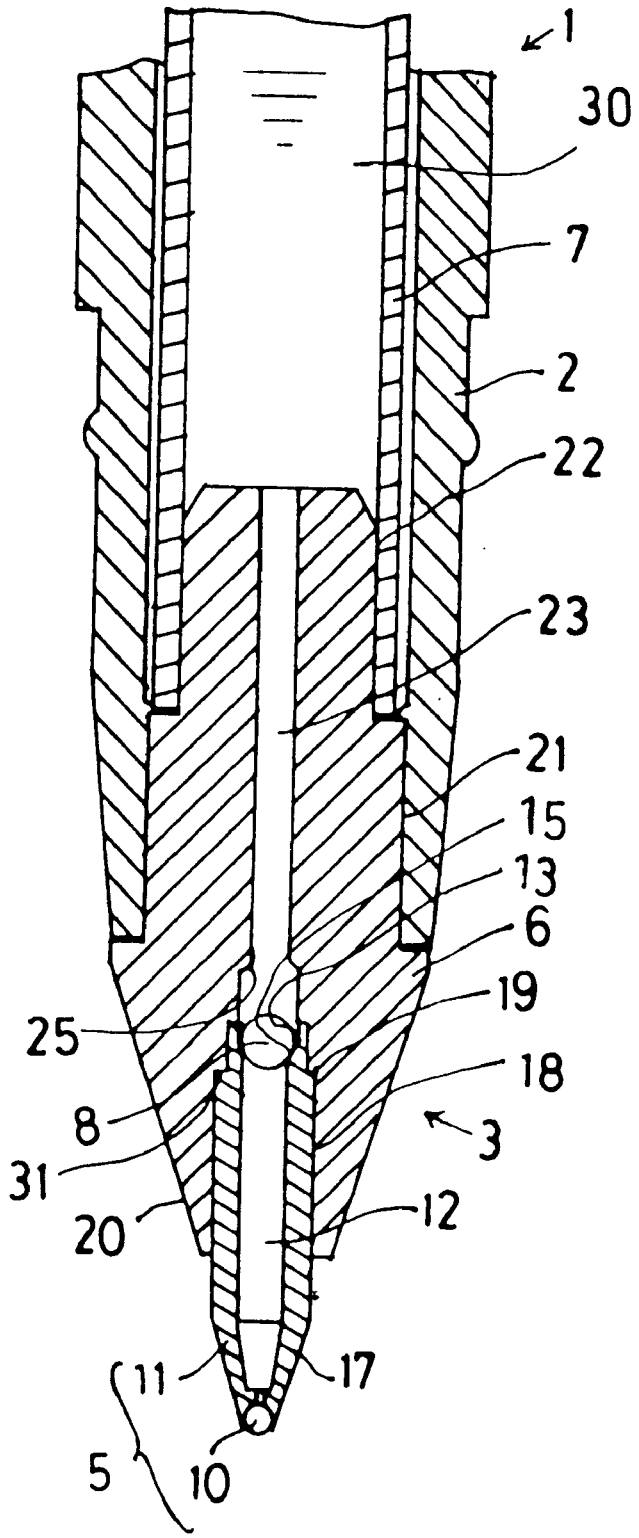
FIG. 2 is a side elevation in section of the principal part of a ball-point pen provided in an embodiment of the present invention.

A ball-point pen 1 in the embodiment shown in FIG. 2 comprises a cylindrical penholder 2 and an ink cartridge or pen body 3. This ink cartridge 3 comprises a writing ball 10 rotationally held in a penpoint tip 5, with this tip being connected by a joint 6 to the distal end of an ink reservoir (viz., an ink-holding part) 7. A spherical valve 8 is disposed in the joint 6.

The penpoint tip 5 consists of a tip body 11 and the writing ball 10 retained in a distal end thereof. This tip body 11 may be formed by machining or cutting a metal such as a free-machining steel, or alternatively another metal such as a free-cutting stainless steel or a brass.

A distal portion 17 of the tip body 11 is of a conical shape, and a proximal portion 18 being of a columnar shape. An annular shoulder 19 is formed near the proximal portion's rear end of a slightly reduced diameter.

Figure 3:
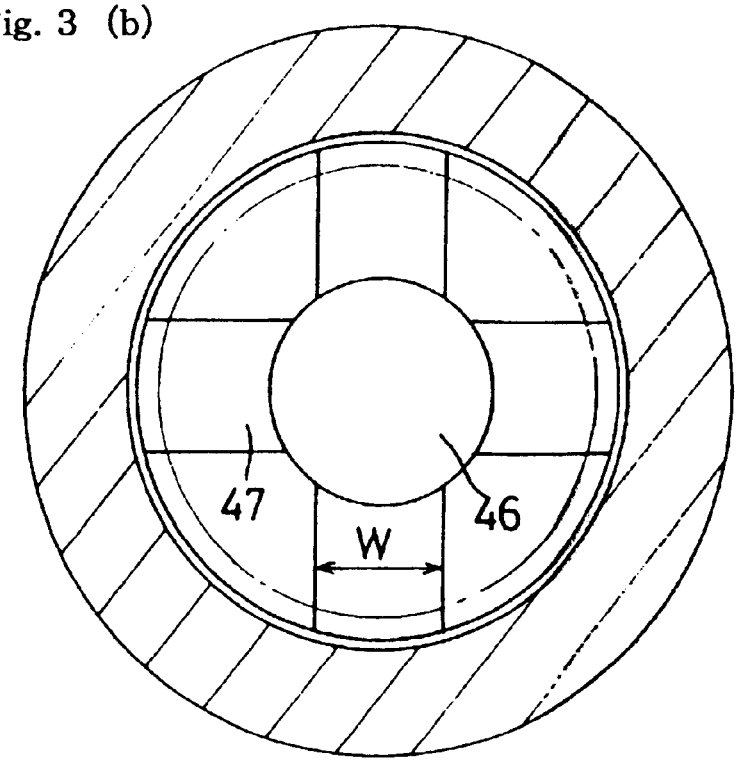
FIG. 3(*a*) is an enlarged side elevation in section of the distal end portion of a penpoint tip constituting the pen shown in FIG. 2.
Figure 3:
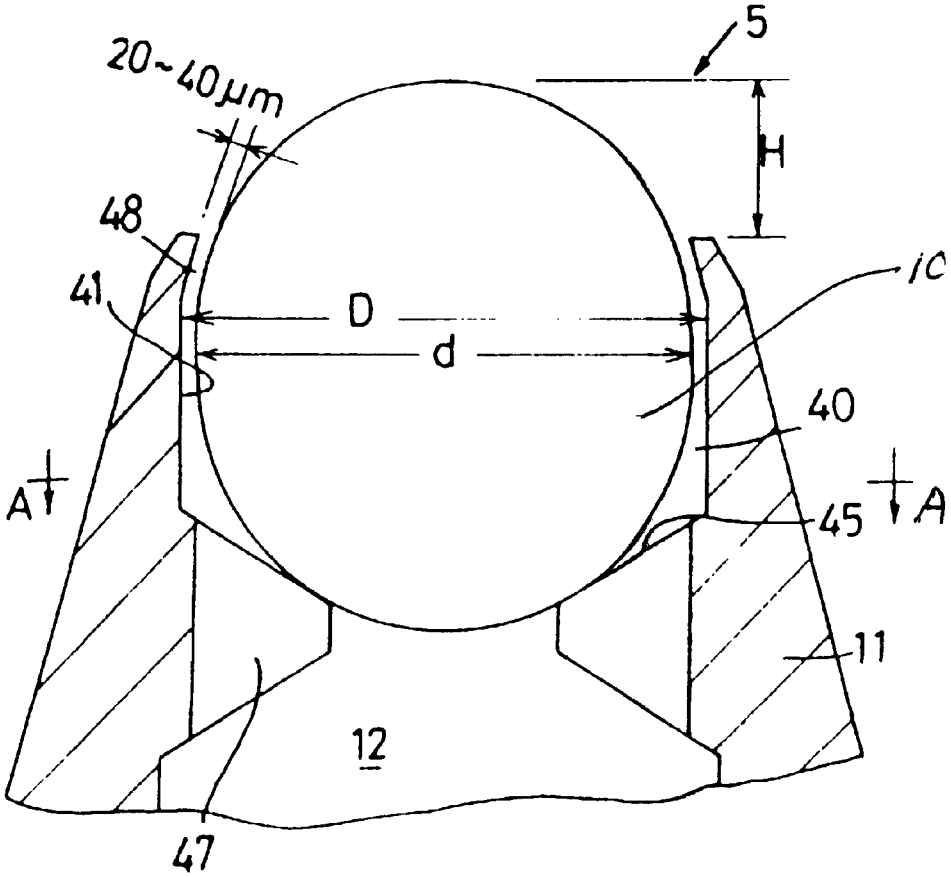

FIG. 3(*a*) and 3(*b*) show the interior of the penpoint tip, wherein a ball chamber 40 holds therein the writing ball 10, and is in a fluid communication with an ink feed bore 12 continuing rearwardly from said chamber.

An increased-diameter portion 13 (FIG. 2) is formed adjacent to the rear end of the ink feed bore 12, with a valve support (viz., valve stopper) 15 being formed therein.

The writing ball 10 kept in position in the ball chamber 40 of the tip body 11 is capable of rotating therein. This chamber 40 as detailed in FIGS. 3(*a*) and 3(*b*) is a cavity of the type having an open end and defined by a cylindrical wall 41. This open end is pressed (viz., 'caulked' (viz., pressed to cause plastic deformation)) in a centripetal direction to be of a slightly decreased diameter.

Formed facing the open end of chamber 40 is an annular seat 45 that is tapered at an angle of about 30° to terminate at the rim around a central opening 46, thereby converging therewith. This opening 46 in turn is in fluid communication with the ink feed bore 12 and has a diameter of about 0.3–0.5 mm.

A cruciform group of radial grooves 47 are formed in a central region the seat 45, with this region sometimes contacting the writing ball in use. As best seen in FIG. 3(*b*), a distal end portion of ink feed bore 12 is of substantially the same diameter as the ball chamber 40, wherein each groove 47 extending also longitudinally of this pen does open into both the chamber 40 and the bore 12.

Each radial groove 47 in this pen 1 has a width 'W' that is greater than that in the prior art ordinary pens and may be from about 0.15 to about 0.5 mm, preferably from 0.15 to 0.5 mm and more preferably from 0.20 to 0.35 mm. Thus, width 'W' will be equal to from about 15 to about 50%, and preferably 25–35% of the diameter 'd' of the writing ball 10.

The prior art writing balls 10 usually have a diameter of from 0.3 to 1.2 mm. However, it is preferable for the ball-point pen, in accordance with the present invention of the embodiment to have a relatively large diameter from about 0.8 to about 1.1 mm, preferably from 0.8 to 1.1 mm, and more preferably from 0.9 to 1.1 mm because an aqueous ink is intended herein to contain coarser pigment particles.

A material for forming such a writing ball 10 is not delimited to any special one, but may be a stainless steel, a sintered alumina, a sintered zirconia, SiC, WC or any other known material comparable therewith.

The writing ball 10 accommodated in and rotating within the chamber 40 is exposed in part out of the caulked opening thereof.

An extent 'H' to which this writing ball 10 is exposed outwards from the penpoint tip is designed such that it will correspond to from about 20 to about 35%, more preferably 25–30% of the ball's, diameter 'd', when the central region of the annular seat in the chamber contacts the ball and its center is aligned with the longitudinal axis of said chamber.

Figure 7:
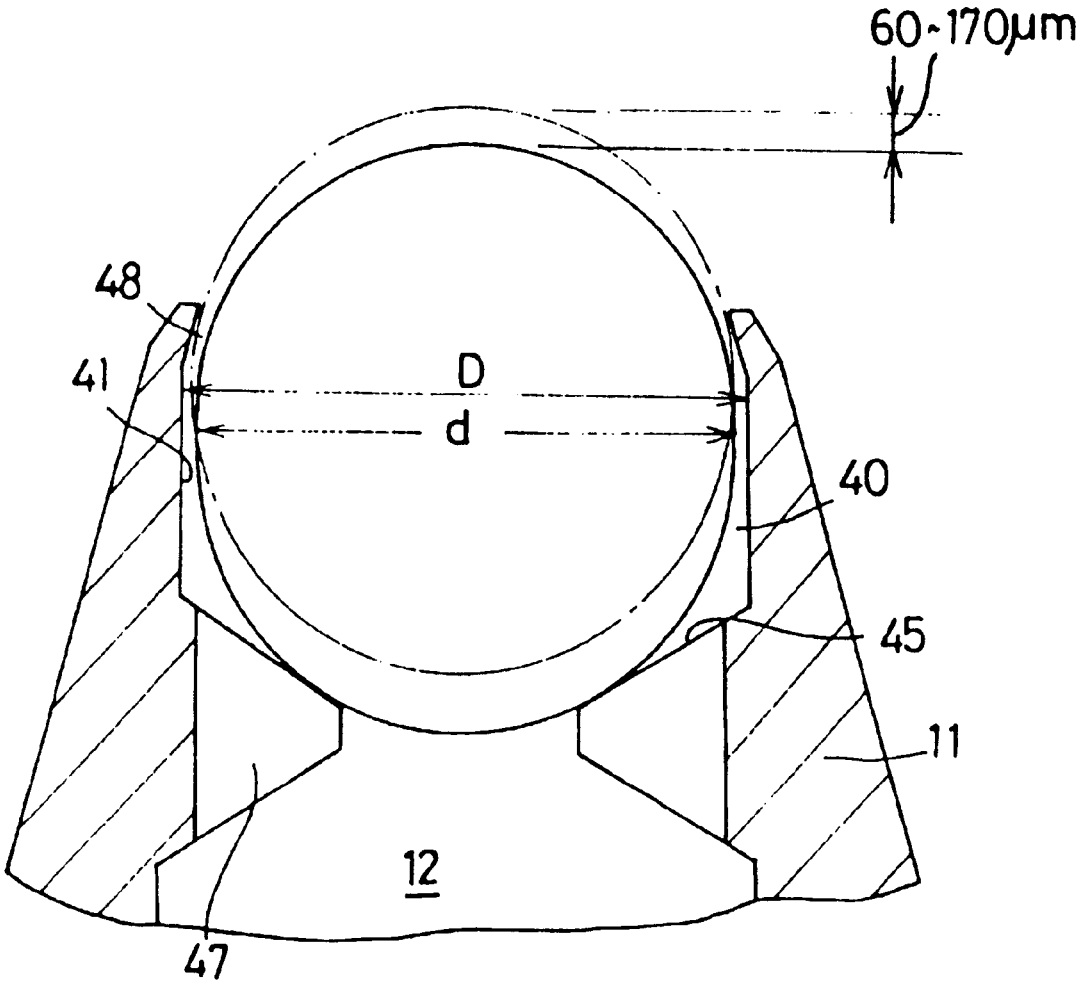
FIG. 7 is an enlarged side elevation section of a distal end portion of the pen shown in FIG. 2 in yet still another embodiment of the present invention.

Preferably, the writing ball has a freedom in axial displacement within the penpoint tip. More preferably, it is movable a distance from about 60 to about 170 $\mu$m longitudinally of the pen as shown in FIG. 7. Thus, clear, smooth and blurless writing free from unintentional broken lines is ensured and a quite excellent writing property is afforded to the pen.

The inner diameter 'D' of the cylindrical wall 41 defining the chamber 40 is designed greater than the diameter 'd' of the writing ball 10 by from about 40 to about 80 $\mu$m. Due to such a relationship between these diameters 'D' and 'd', an annular clearance 48 around the ball 10 and between same and the inner periphery of ball chamber 40 will be 20 to 40 $\mu$m thick in the radial direction at the ball's 'equator', when the ball takes a position of FIG. 3(*a*). The term 'equator' denotes an imaginary circle appearing when a plane (that includes the ball center and lies perpendicular to the chamber axis) intersects said ball. Therefore, opposite ends of the arrow line 'd' shown in FIG. 3(*a*) will be included in such an equator.

Since the distal end portion of the chamber 40 has such a periphery caulked in a centripetal fashion to be of concave shape matching, or facing the ball, such a clearance 48 of from tabout 20 to about 40 $\mu$m and preferably from 20 to 40 $\mu$m, will be ensured for all over the ball's 10 surface regions that are located outwardly of the equator but not exposed out of the said chamber.

The clearance 48 between the writing ball 10 and the ball chamber wall 40 serves as an annular ink passage, as usual. Because, however, the ball-point pen, in accordance with the present invention of the embodiment is for use with an aqueous ink having dispersed therein coarser pigment particles as will be detailed below, the clearance 48 is made broader than in the known ordinary pens. The lower limit set forth above of this clearance is determined herein to match pigments whose average particle diameter is from 20–50 μm. If the clearance is narrower than this lower limit, then the ball chamber 40 will probably be jammed with those pigments. If, on the contrary, the clearance 48 is much broader exceeding the upper limit, that is 40 μm, then the writing ball 10 will not work in any reliable manner and, at worst, may it possibly slip off the chamber 40.

The joint 6, (FIG. 2) which may be made by injection molding a polypropylene, or the like thermoplastic resin, is of an outer configuration similar to those known and conventional in this field. Thus, it has a conical distal portion 20 and a stepped and cylindrical proximal portion composed of a larger diameter part 21 and a smaller diameter part 22. A bore 23 penetrates an axial portion of this joint 6, and a valve seat 25 is formed therein and disposed intermediate the front and rear ends of the bore. A positioning annular step 31 also formed in this bore 23 is located ahead of said seat and nearer the distal end of joint.

The spherical valve 8 is a ball made of a corrosion-proof material of a relatively high specific gravity, such as a stainless steel, a hard alloy or a ceramics.

The ink reservoir (i.e., ink holder) 7 is a cylinder made by extruding a polyethylene, a polypropylene, or the like, resin so as to be filled with the brilliant aqueous ink 30 containing one type of glass flake pigments, whose average particle diameter is from about 20 to about 50 μm, preferably from 20 to 50 μm. The most coarse particles in those types of pigments will however vary in their diameter within a range from about 40 to about 200 μm.

Such an ink in this embodiment has a viscosity from about 1000 to about 10000 mPa·S (measured in an ELD type viscometer made by the TOKI-MEC Co., Ltd., having an 'R14' rotor of 3° rotating at 0.5 rpm at 20° C.). The proximal end of the aqueous ink 30 is sealed with a sealant gel (not shown) such as a polybutene.

The pen body or cartridge 3 consists of the penpoint tip 5 and the ink reservoir 7 fixedly connected thereto by the joint 6. This tip 5 fits in the distal region of bore 23 formed in the joint 6, and the reservoir 7 fits on the smaller diameter part 22 that is formed as the proximal region of said joint. The valve 8 interposed between the valve support 15 in penpoint tip 5 and the valve seat 25 in joint 6 is movable fore and aft between them in an axial direction. Fitted on the larger diameter part 21 of the joint 6 constituting the pen body 3 is the penholder 2.

When characters or the like are written using the ball-point pen 1 of the embodiment, a continuous amount of the aqueous ink 30 will flow out of the ink reservoir 7 and enter the ball chamber 40 so as to be transferred onto a paper sheet or the like through the writing ball 10. In this embodiment, the radial grooves 47 (FIGS. 3(*a*) and 3(*b*)) formed in the annular seat 45 formed for supporting the ball within the chamber 40 are each of a large width 'W'. Even huge particles or flakes constituting the glass flake pigment can flow smoothly through those grooves, without encountering any trouble.

The clearance 48 present between the ball 10 of this pen 1 and the chamber's 40 inner periphery is large enough for the ink, so that those huge flakes of said pigment are further facilitated to flow smoothly through that clearance.

Tests were carried out to evaluate the effects of the present invention, as follows.

As first samples, several ball-point pens, as illustrated in FIG. 2, were manufactured for test. Each pen comprised a writing ball 10 having a diameter of 1.0 mm, and one group of those samples had the radial grooves each being 0.2 mm wide, with the other group having their grooves 0.3 mm wide. The inner diameter 'D' of the periphery 41 of each ball chamber was larger than the diameter 'd' of the writing ball 10 by 40 μm.

The ink filled in each pen was a brilliant aqueous ink 30 containing glass flake pigment. Average diameter of the particles of this ink was 40 μm, and a maximum diameter of the largest particle was of a diameter of 175 μm.

First references for comparison with said first samples were also prepared, wherein each reference had the grooves 47 of a width of 0.14 mm and other structural features and the ink were the same as those in the first samples.

Writing tests were done using those samples and first references to prove the former excellent in flow of the ink. In contrast, the references caused unintentional broken lines in the writings from the start of the test and finally completely stopped the ink.

As second references, further pens were prepared wherein the inner diameter 'D' of the periphery 41 of each ball chamber was larger than the diameter 'd' of the writing ball 10 by 35 μm, with the other structural features being made the same as those in the first samples. These second references were tested for comparison with the samples to find out a lower limit for the clearance between the writing ball and the inner periphery of the ball chamber. As a result, pens as those second references showed clogging of the penpoint tips, thus showing that a clearance of 17.5 μm was not enough for the ink to flow smoothly.

Figure 4:
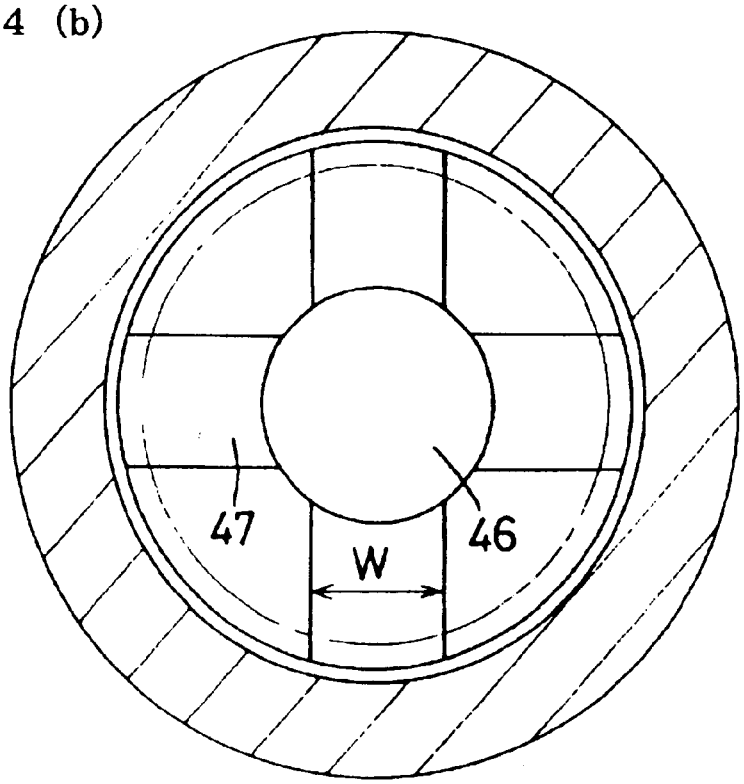
FIG. 4(*a*) is an enlarged side elevation section in of the distal end portion of a penpoint tip that constitutes a ball-point pen in, accordance with another embodiment of the present invention.
Figure 4:
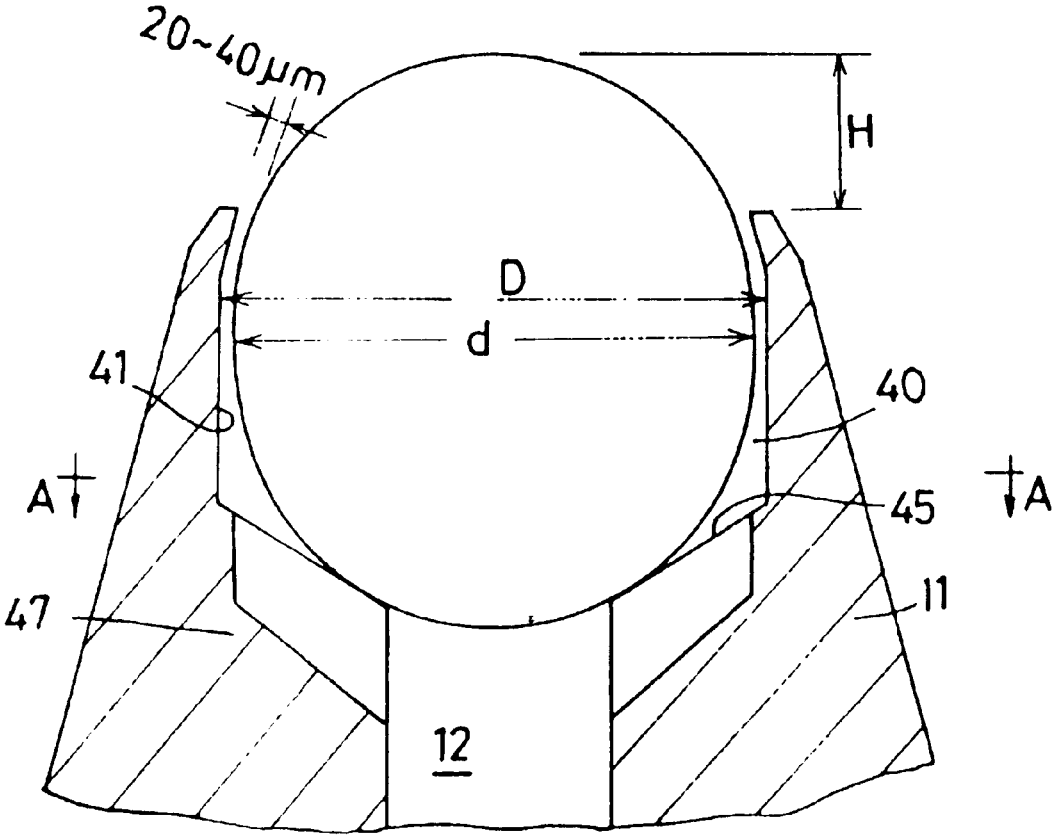

As modified samples of the present invention, further pens were prepared whose radial grooves 47 in the seat 45 did not extend straightly into the ink feed bore 12 in axial direction of each pen as shown in FIG. 4(*a*), with the other structural features being made the same as those in the first samples. Similar tests revealed that also these modified samples provided an excellent writing property, without suffering any clogging with the ink. In the case wherein the grooves 47 were of a depth less than 0.15 mm, the writing property was almost unsatisfactory and clogging with the ink took place.

Figure 5:
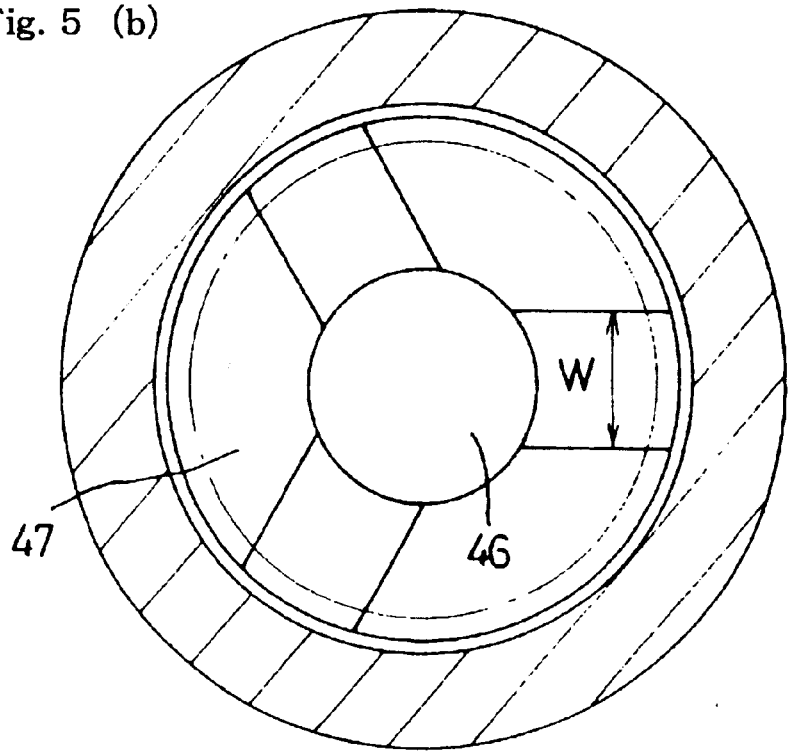
FIG. 5(*a*) is an enlarged side elevation in section of the distal end portion of a penpoint tip that constitutes a ball-point pen in, accordance with still another embodiment of the present invention.
Figure 5:
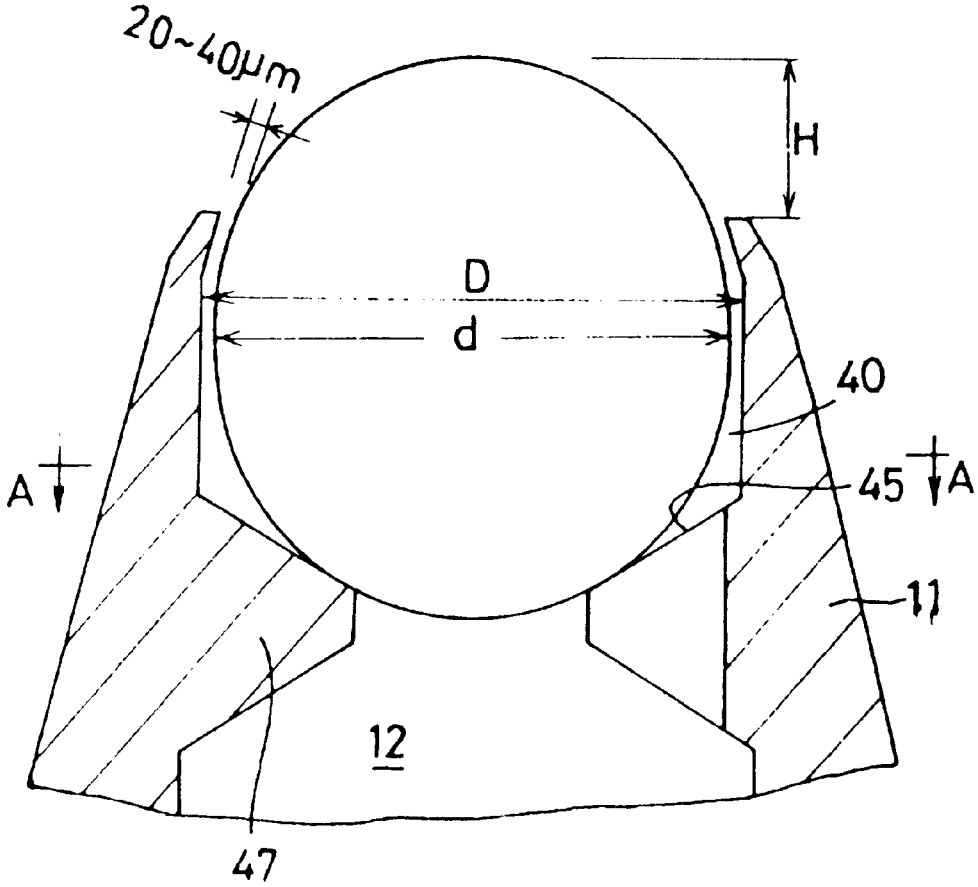
Figure 6B:
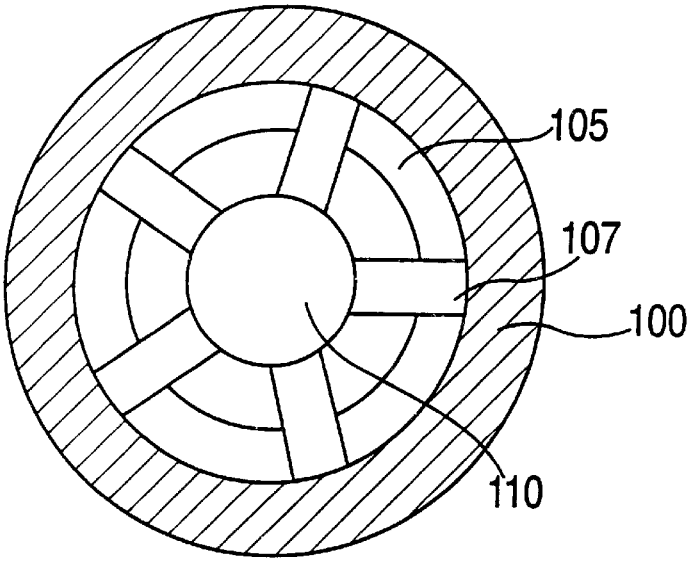
FIG. 6(b) (PRIOR ART)
FIG. 6(*a*) is an enlarged side elevation in section of the distal end portion of a penpoint tip that constitutes the prior art ball-point pen.
Figure 6A:
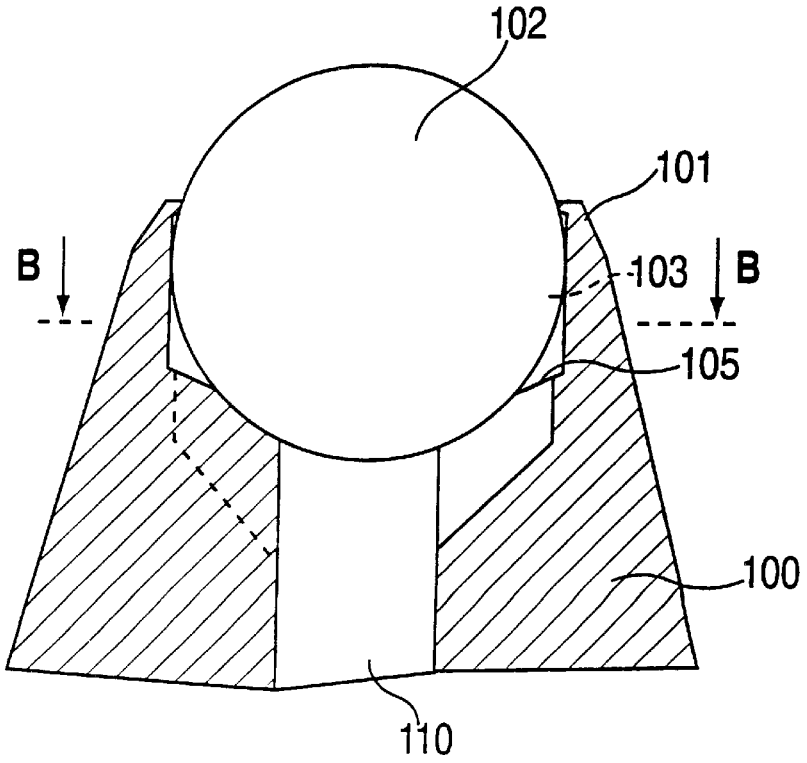
FIG. 6(a) (PRIOR ART)

As further modified samples of the present invention, additional pens were prepared wherein the number of radial grooves 47 in each of them was 3 (three) as shown in FIG. 5(*a*). These pens also showed an excellent writing without any unintentional broken lines or clogging with the ink. Width of each groove 47 was the same as that in the case of the cruciform group of grooves, and it has been found that each groove 0.15–0.5 mm wide, more preferably 0.20–0.3 mm wide, did provide excellent writings without causing the pens to be clogged with the ink.

In addition, further two groups of test ball pens were prepared, wherein the one group of them respectively had the groove width 'W' of 0.1 mm, 0.2 mm or 0.3 mm for the same writing ball diameter of 0.8 mm. The other group of them respectively had also the groove width 'W' of 0.1 mm, 0.2 mm or 0.3 mm for the same writing ball diameter of 1.0 mm. All the grooves were of the shape shown in FIG. 5(*a*) and the number of them in each was 3 (three) as shown in FIG. 5(*b*).

These ball-point pens were then filled with the same ink as above for the purpose of writing tests. Results thus obtained and shown in the following Table-1 shows that a critical threshold exists, with respect to flowability of ink, between the groove width of 0.1 mm and the groove with of 0.2 mm, thus confirming that the width 0.15 mm is truly critical. These data shows also that another critical threshold exists, also with respect to flowability of ink, between the writing ball diameter of 0.8 mm and the diameter of 1.0 mm, except for a case of each groove wider than 0.2 mm even with the ball diameter of 0.8 mm wherein no clogging with the ink was observed but some broken lines were produced.

Thus, most desirable is a combination of the writing ball diameter of 1.0 mm or more with the groove width of 0.2 mm or more.

TABLE-1

| Width of the Grooves | Diameter of the Writing Ball (mm) | |
|---|---|---|
| (mm) | 0.8 | 1.0 |
| 0.1 | × | × |
| 0.2 | Δ | ○ |
| 0.3 | Δ | ○ |

Notes:
The symbol '×' denotes the pen clogged with the ink, the symbol 'Δ' denotes broken lines in each writing, and the symbol '○' denotes excellent writings.

In the embodiments just described above in detail, glass flake pigments were used. Metal-coated inorganic pigments also proved effective to the same degree as in the case of glass flake pigments. It has likewise been confirmed that the present invention could work successfully also in other cases wherein the aqueous ink would contain an aluminum powder pigment whose constituent particles had a maximum diameter of 40–200 μm and/or an average diameter of 20–50 μm.

Summarizing the foregoing description, the radial grooves in the ball chamber have each a width of 0.15 mm or more, so that the aqueous ink containing any huge constituent particles possibly present in the glass flake pigment, the metal-coated pigment or the like can provide clear writings free from unintentional broken lines, affording an excellent writing property to the pen.

The writing ball in the present embodiment may preferably have a diameter falling within a range of from about 0.3 to about 1.2 mm, more preferably from about 0.8 to about 1.1 mm, and most preferably from about 0.8 to about 1.0 mm.

This writing ball is displaceable fore and aft an axial distance of from about 60 to about 170 μm (preferably from 60 to 170 μm) within the penpoint tip. This distance may be adjusted by changing and controlling the degree to which the opening of the penpoint tip is caulked (viz., pressed to cause plastic deformation). Additionally or alternatively, strength may be changed at which the ball is struck onto the inner peripheral wall defining a ball chamber so as to form therein a recessed seat of a crater-like shape. It also may be possible to change the protrusion of the writing ball out of the opening, or to change the ball chamber in depth, so as to adjust the ball displacement distance without altering the diameter of said opening.

As the general structure of the ball-point pen in this embodiment is similar to that in the above-described embodiment, this embodiment is described referring again to FIG. 2, a vertical cross section of the principal part of a ball-point pen provided in an embodiment of the present invention.

FIG. 7 is an enlarged cross section of a distal end portion of the pen shown in FIG. 2 in this yet still another embodiment.

A ball-point pen 1 in an embodiment comprises a cylindrical penholder 2 and an ink cartridge or pen body 3. This ink cartridge 3 comprises a writing ball 10 rotationally held in a penpoint tip 5, with this tip being connected by a joint 6 to the distal end of an ink reservoir 7. A spherical valve 8 is disposed in the joint 6.

The penpoint tip 5 consists of a tip body 11 and the writing ball 10 retained in a distal end thereof. This tip body 11 may be formed by machining or cutting a metal such as a free-machining steel, or alternatively another metal such, as a free-cutting stainless steel or a brass.

A distal portion of the tip body 11 is of a conical shape, and a proximal portion being of a columnar shape. An annular shoulder 19 is formed near the proximal portion's rear end of a slightly reduced diameter.

FIG. 7 shows the interior of the penpoint tip 5, wherein a ball chamber 40 holds therein the writing ball 10, and is in a fluid communication with an ink feed bore 12 continuing rearwardly from said chamber.

An increased-diameter portion 13 is formed adjacent to the rear end of the ink feed bore 12, with a valve support (viz., valve stopper) 15 being formed therein.

The writing ball 10 kept in position in the ball chamber 40 of the tip body 11 is capable of rotating therein. This chamber 40 as detailed in FIG. 7 is a cavity of the type having an open end and defined by a cylindrical wall 41. This open end is pressed (viz., 'caulked') in a centripetal direction to be of a slightly decreased diameter.

Formed facing the open end of chamber 40 is an annular seat 45 that is tapered at an angle of about 30° to terminate at the rim around a central opening 46, which in turn communicates with the ink feed bore 12.

The writing ball 10 accommodated in and rotating within the chamber 40 is exposed in part out of the caulked opening.

The writing ball 10 in this embodiment is freely movable in axial direction a certain limited distance, and in more detail, is movable a distance of from about 60 to about 170 μm as depicted in FIG. 7.

If the writing ball 10 is axially movable only a short distance less than about 60 μm, then the ball chamber 40 will be clogged with the pigment present in the ink. If contrarily the ball is movable over a longer distance more than about 170 μm, then it will not be able to move smoothly. In this case, an extent to which the ball is exposed outwards from the distal annular edge of penpoint tip will be so small that this edge tends to scratch a paper sheet, resulting in unsmooth writing.

The joint 6, which is made by injection molding a polypropylene, or the like, thermoplastic resin, is of the shape similar to those known and conventional in this field. Thus, it has a conical distal portion 20 and a stepped and cylindrical proximal portion composed of a larger diameter part 21 and a smaller diameter part 22. A bore 23 penetrates an axial portion of this joint 6, and valve seat 25 is formed therein and disposed intermediate the front and rear ends of the bore. A positioning annular step 31 also formed in this bore 23 is located ahead of said seat and nearer the distal end of joint.

The spherical valve 8 is a ball made of a corrosion-proof material of a relatively high specific gravity, such as a stainless steel, a hard alloy or a ceramics.

The ink reservoir (i.e., ink holder) 7 is a cylinder made by extruding a polyethylene, a polypropylene, or the like resin so as to be filled with the thixotropic aqueous ink containing a pigment, whose average diameter is 20–50 μm. In this embodiment, the ink 30 is a brilliant aqueous ink containing an aluminum powder pigment and showing a thixotropic property. Such an ink in this embodiment has a viscosity of from about 100 to about 20000 mPa·S (measured in an ELD type viscometer that has an 'R14' rotor of 3° rotating at 0.5 rpm at 20° C.). The proximal end of the aqueous ink 30 is sealed with a sealant gel (not shown) such as a polybutene.

The pen body or cartridge 3 consists of the penpoint tip 5 and the ink reservoir 7 fixedly connected thereto by the joint 6. This tip 5 fits in the distal region of bore 23 formed in the joint 6, and the reservoir 7 fits on the smaller diameter part 22 that is formed as the proximal region of said joint. The valve 8 interposed between the valve support 15 in the penpoint tip 5 and the valve seat 25 in the joint 6 is movable fore and aft between them in an axial direction. Fitted on the larger diameter part 21 of the joint 6 constituting the pen body 3 is the penholder 2.

As described above, the writing ball 10 in the ball-point pen 1 of the present embodiment can move axially a distance of from about 60 to about 170 μm, so that an enough flow passage is ensured for the aluminum powder pigment to pass through it smoothly, thereby affording a good flowability to the ink.

EXAMPLES

Tests were carried out to evaluate the effects of the present invention, as follows.

As a First Example, ten ball-point pens, in accordance with the present invention and as illustrated in FIGS. 2 and 7 were manufactured for test. Each pen comprised a writing pen 10 having a diameter of 0.8 mm and movable a distance of 60–120 μm in axial direction. The ink filled in each pen was a brilliant, aqueous and thixotropic ink 30 containing an aluminum powder pigment. This ink showed a viscosity of 100–20000 mPa·S (by ELD viscometer, with 'R14' cone of 3° rotating at 0.5 rpm at 20° C.).

Prepared as a First Reference-1 were ten pens, the writing balls thereof being able to move 40 μm or more but less than 60 μm. Further ball-point pens with balls movable 170 to 200 μm were prepared as First Reference-2. The diameter of each writing ball as well as the ink were the same as those in the First Example.

A continuous writing test was conducted to find that: the pens as the First Example (with writing balls movable 60 to 120 μm) did show no blurs, whereas the other pens as the First Reference-1 (with writing balls movable 40 to 60 μm, and less than 60 m) showed blurs and incontinuities in written lines, indicating a poor flowability of the ink.

The further pens as First Reference-2 (with writing balls movable 170 to 200 μm, and more than 170 μm) showed neither blurs nor incontinuities in written lines, indicating a good flowability of the ink. However, the distal edges of their penpoint tips did scratch a paper sheet, proving that those reference pens were insufficient in their writing property.

As a Second Example, ten ball-point pens, in accordance with the present invention were manufactured for a further test, wherein each pen comprised a writing pen 10 having a diameter of 1.0 mm and movable a distance of 60–170 μm in axial direction. The ink filled in each pen was a brilliant, aqueous and thixotropic ink 30 containing a glass flake pigment. This ink showed a viscosity of 100–20000 mPa·S (by ELD viscometer, with 'R14' cone of 3° rotating at 0.5 rpm at 20° C.).

Prepared as a Second Reference-i were also ten pens, the writing balls thereof being able to move 40 μm or more but less than 60 μm. Additional ball-point pens with balls movable 170 to 200 μm were prepared as Second Reference-2. The diameter of each writing ball as well as the ink were the same as those in the Second Example.

Another continuous writing test was conducted to find that: the pens as the Second Example (with writing balls movable 60 to 170 μm) did show no blurs, whereas the other pens as the Second Reference-1 (with writing balls movable 40 to 60 μm, and less than 60 μm) showed blurs and incontinuities in written lines, indicating a poor flowability of the ink.

The further pens as the Second Reference-2 (with writing balls movable 170 to 200 μm, and more than 170 μm) showed neither blurs nor incontinuities in written lines, indicating a good flowability of the ink. However, the distal edges of their penpoint tips did scratch a paper sheet, proving that those reference pens were insufficient in their writing property.

It can now be concluded from these tests that the writing balls of a diameter of from about 0.8 to about 1.0 mm and movable from about 60 to about 170 μm axially within their penpoint tips will afford a smooth and excellent flowability to thixotropic inks which, for use with these writing balls, may contain a brilliant pigment, an aluminum powder pigment or the like.

In summary, the ball-point pen of the present invention is advantageous in that, due to its writing ball's axial movability of from about 60 to about 170 μm within its penpoint tip, clear, smooth and blurless writings are ensured even when used with a thixotropic ink that may contain as its ingredient a glass flake pigment, a titanium oxide pigment, a metal-coated inorganic pigment, an aluminum powder pigment, or a pearl-glossy pigment and even if particles of these would possibly have a average diameter of 20–50 μm.

What is claimed is:

1. A ball-point pen comprising:

a. an ink reservoir, b. a penpoint tip, c. a writing ball rotationally disposed in and partially exposed from the penpoint tip, d. an ink feed bore in fluid communication with the ink reservoir, e. a ball chamber holding the writing ball and formed in fluid communication with the ink feed bore, f. an annular seat formed in the chamber so as to support the writing ball, and g. radial grooves formed in the annular seat, characterized in that each of the radial grooves is of a width of more than 0.2 mm.

2. A ball-point pen as defined in claim 1, wherein an aqueous ink filled in the reservoir contains a pigment including coarse particles whose maximum diameter is from 40 μm to 200 μm.

3. A ball-point pen as defined in claim 1, wherein the aqueous ink filled in the reservoir contains a pigment whose particles have an average diameter falling within a range of from about 20 to about 50 μm.

4. A ball-point pen as defined in claim 1, wherein at least one pigment selected from the group consisting of glass flake pigments, titanium oxide pigments, metal-oxide coated inorganic pigments, metal powder pigments, and pearl-glossy pigments are contained in the aqueous ink.

5. A ball-point pen as defined in claim 1 wherein the writing ball has a diameter of 0.8 mm or more.

6. A ball-point pen as defined in claim 1, wherein the writing ball has a diameter of 0.9 mm or more.

7. A ball-point pen as defined in claim 1, wherein an annular ink passage having a depth of from about 20 to about 40 μm in radial direction is provided when the writing ball rests on the seat in such a state that a center of the ball is aligned with a longitudinal axis of the ball chamber, wherein the depth is defined between an inner periphery of the chamber and a peripheral zone of the ball, with this zone being located downstream of an equator of the ball and adjacent to a distal end opening of the chamber.

8. A ball-point pen comprising:

a. an ink reservoir, b. a penpoint tip, c. a writing ball rotationally disposed in and partially exposed from the penpoint tip, d. an ink feed bore in fluid communication with the ink reservoir, e. a ball chamber holding the writing ball and formed to be in fluid communication with the ink feed bore, f. an annular seat formed in the chamber so as to support the writing ball, and g. radial grooves formed in the annular seat, wherein the writing ball has a diameter of about 1.0 mm or more, each of the radial grooves is of a width of more than 0.2 mm, and the aqueous ink filled in the reservoir contains a glass flake pigment whose particles of varied diameters have a maximum diameter included in a range from about 40 $\mu$m to about 200 $\mu$m.

9. A penpoint tip in a ballpoint pen, the tip comprising:

a. a writing ball, b. a tip body, c. an ink inlet formed in the tip body so as to receive an ink from an ink reservoir disposed adjacent to the tip and in fluid communication therewith, d. a ball chamber holding therein the ball and formed in fluid communication with the ink inlet, e. the chamber having a distal end opening, f. an annular seat for the ball and g. a plurality of radial grooves formed in the seat, the writing ball being capable of rotating within the chamber and exposed outwards and partially from the distal end opening of the chamber, wherein the writing ball has a diameter of about 0.9 mm or more, each of the radial grooves is of a width of more than 0.2 mm, and an annular ink passage having a depth of from about 20 to about 40 $\mu$m in radial direction is provided when the writing ball resting on the seat has a center aligned with the longitudinal axis of the ball chamber, wherein the depth is defined between an inner periphery of the chamber and a peripheral zone of the balls with the peripheral zone being located downstream of an equator of the ball and adjacent to the distal end opening of the chamber.

10. A ball-point pen that comprises:

a. an ink reservoir, b. a penpoint tip in fluid communication therewith, c. a writing ball rotationally held in and partially exposed from the penpoint tip, and d. a thixotropic ink filled in the reservoir, wherein the writing ball is movable a distance of from about 60 to about 170 $\mu$m within the penpoint tip and longitudinally of the pen.

11. A ball-point pen as defined in claim 10, wherein the ink filled in the reservoir contains at least one pigment whose particles have a maximum diameter of from about 40 to about 200 $\mu$m.

12. A ball-point pen as defined in claim 10, wherein the ink filled in the reservoir contains at least one pigment whose particles have an average diameter of from about 20 to about 50 $\mu$m.

13. A ball-point pen as defined in claim 10, wherein the ink filled in the reservoir contains the at least one pigment selected from the group consisting of glass flake pigments, titanium oxide pigments, metal-oxide coated inorganic pigments, metal powder pigments, and pearl-glossy pigments.

14. A ball-point pen as defined in claim 10, wherein the diameter of the writing ball is from about 0.8 to about 1.1 mm.

15. A ball-point pen that comprises:

a. an ink reservoir, b. a penpoint tip in fluid communication therewith, c. a writing ball rotationally held in and partially exposed from the penpoint tip, and d. a thixotropic ink filled in the reservoir, wherein the writing ball, the diameter of which is from about 0.8 to about 1.0 mm, is movable a distance of from about 60 to about 170 $\mu$m within the penpoint tip and longitudinally of the pen, wherein the ink filled in the reservoir contains at least one pigment, whose particles have an average diameter of from about 20 to about 50 $\mu$m, selected from the group consisting of glass flake pigments, titanium oxide pigments, metal-oxide coated inorganic pigments, metal powder pigments, and pearl-glossy pigments.

* * * * *